US005178388A

United States Patent [19]

Schlenker

[11] Patent Number: 5,178,388

[45] Date of Patent: Jan. 12, 1993

[54] RACKET FOR STRIKING A BALL

[76] Inventor: Eckard Schlenker, Allmendäckerstrasse 6/1, 7533 Tiefenbronn-Mühlhausen, Fed. Rep. of Germany

[21] Appl. No.: 695,922

[22] Filed: May 6, 1991

[30] Foreign Application Priority Data

May 10, 1990 [DE] Fed. Rep. of Germany ..... 4014999

[51] Int. Cl.[5] ..... A63B 49/02

[52] U.S. Cl. ..... 273/73 R; 273/73 L

[58] Field of Search ..... 273/73 R, 73 C, 73 E, 273/73 G, 73 L

[56] References Cited

U.S. PATENT DOCUMENTS

| | | | |
|---|---|---|---|
| 4,094,505 | 6/1978 | Beall, Jr. . | |
| 4,655,455 | 4/1987 | Kurusu | 273/73 C |
| 4,915,382 | 4/1990 | Madsen | 273/73 L X |
| 5,002,278 | 3/1991 | Costa | 273/73 G X |

FOREIGN PATENT DOCUMENTS

| | | | |
|---|---|---|---|
| 0207308 | 1/1987 | European Pat. Off. . | |
| 1954912 | 7/1971 | Fed. Rep. of Germany . | |
| 3038709 | 5/1982 | Fed. Rep. of Germany | 273/73 L |
| 8225195 | 12/1982 | Fed. Rep. of Germany . | |
| 2581317 | 11/1986 | France | 273/73 L |
| 1227214 | 4/1986 | U.S.S.R. | 273/73 R |
| 1907 | of 1886 | United Kingdom . | |
| 431394 | 7/1935 | United Kingdom | 273/73 G |

*Primary Examiner*—Benjamin H. Layno
*Assistant Examiner*—William E. Stoll
*Attorney, Agent, or Firm*—Henry M. Feiereisen

[57] ABSTRACT

A racket for striking a ball, in particular a tennis racket includes a closed inner stringed frame which is at least partly enclosed by an outer support frame, with both frames being hingedly connected by at least two joints such that a local rotation of both frames relative to each other is permitted at the points of articulation. The joints are arranged relative to each other in such a manner that the inner frame is prevented from carrying out a rigid-body motion relative to the outer support frame and that both frames are prevented from carrying out a translational movement perpendicular to each other perpendicular to the racket plane.

22 Claims, 13 Drawing Sheets

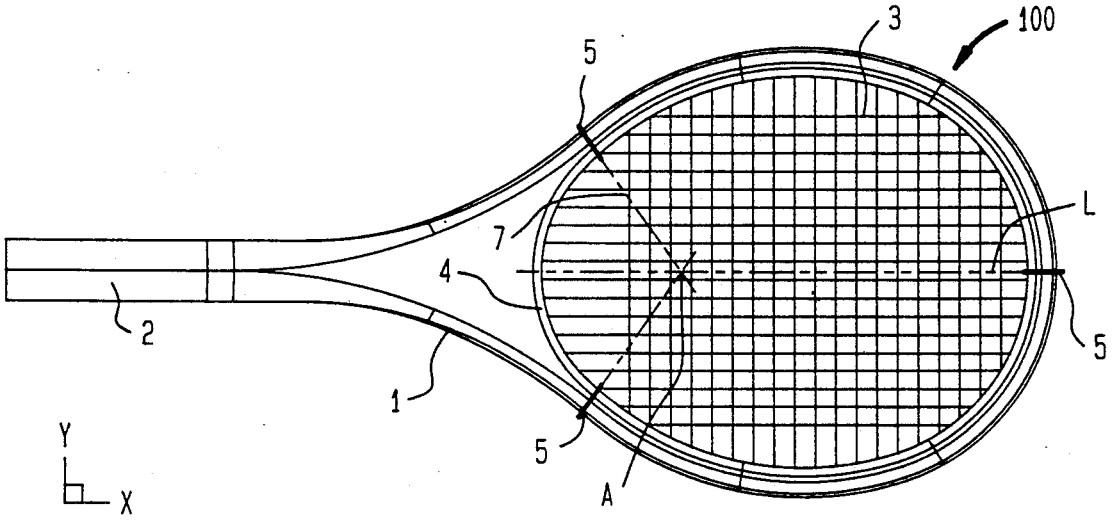
FIG. 1b
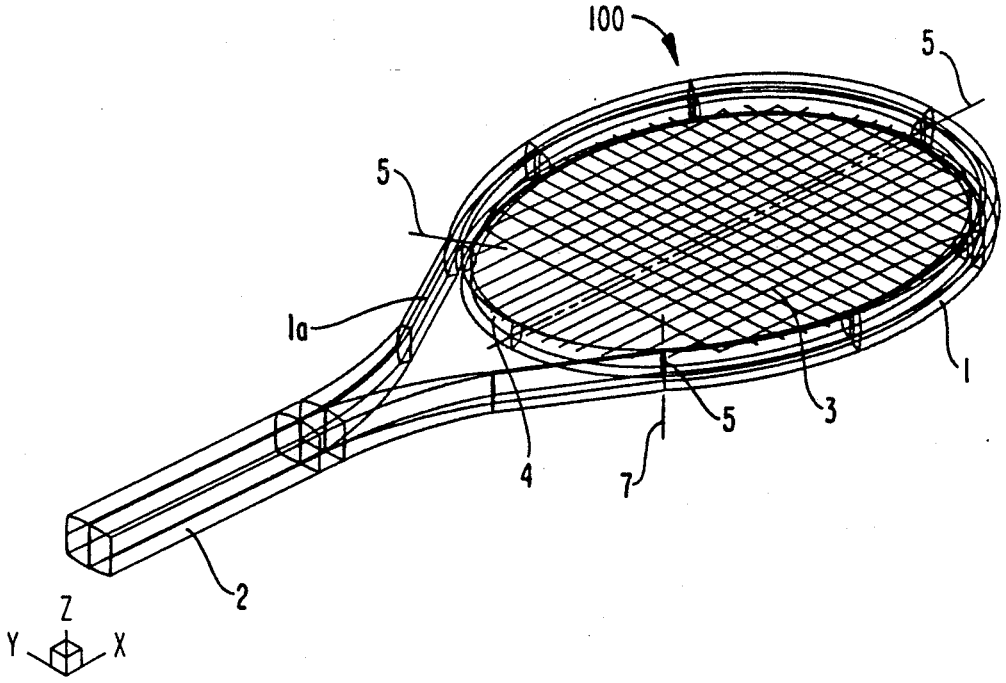

RACKET FOR STRIKING A BALL

BACKGROUND OF THE INVENTION

The present invention refers to a racket for striking a ball, and in particular to a tennis racket of the type having a closed inner stringed frame and an outer support frame which at least partly surrounds the inner frame and is connected to a handle, with both frames being connected at various points.

A two-framed racket of this type is known from German publication DE-OS 27 25 471 which describes a racket with an inner stringed frame detachably secured to a bifurcated shaft/handle portion via vibration-absorbing buffer elements at various locations. The buffer elements are spaced essentially symmetrical to the transverse center plane of the frame, with the number of buffer elements varying and representing the main variable. By modifying the hardness of the flexible buffer elements (silent blocks), the frequency band of filtered and absorbed oscillations of higher frequency is to be regulated. This represents the second variable. A typical characteristic for this design is the dissipation and conversion of high frequency oscillation energy in deformation energy and thus the irreversible conversion in heat energy.

The multipoint connection by means of block-shaped buffer elements with their known linear-elastic spring characteristics allows only a very limited relative movement through vibration of the thus flexibly linked subsystems. These buffer elements absorb vibrations which would otherwise propagate to the shaft/handle portion. The design of the buffer elements is only restricted by the requirement of converting a vibration of the inner frame in a deformation of one part of the buffer element.

The teaching of the racket according to the German publication DE-OS 27 25 471 is based on dynamic absorption of vibrations in the buffer elements, with the frequency band to be absorbed being controlled by the type of buffer elements and only restricted to higher frequencies. This publication is silent as to the design of the racket head in respect to profile, positions of the center of gravity, and absolute and relative positioning of the support between inner and outer frames.

German publication DE-OS 21 16 920 discloses a racket in which an elastic movement of the racket head relative to the handle is attained by maintaining the angular position of the racket head relative to the handle through arrangement of elastic members—primarily pin-supported coil springs outside the racket head. A constant in all embodiments disclosed in this prior art is the fact that the inner and outer frame planes remain parallel during the relative movement. The difference between various embodiments resides in the impact of the elastic members on individual or grouped, partly elastically linked strings.

Coil springs have a linear-elastic spring characteristic. Because of the plurality of springs and the limited space and spring travel, the springs in their entirety define a spring-mass system with higher eigenfrequency and smaller amplitude of oscillation. A particular feature of this racket resides in the force transfer from inner frame to outer frame along the longitudinal frame perimeter. In particular, the springs have to be positioned at the crown-near side and handle-near side of the racket head and should have sufficient stiffness in order to retain the angular position when balls impact in these areas.

Impulses and impact forces are thus transmitted essentially via the entire outer frame area into the handle. In the event this racket uses pins, the latter serve for connecting the elastic members and the filaments of the strings.

A racket of this type has thus a multipoint support of the frame parts, with resilient coil springs/leaf springs allowing a purely translational and limited relative movement. Vibrations are absorbed essentially by internal friction at harmonic expansion i.e. through stiffness damping. Frame and elastic members suffer irreversible thermal losses (heat) during work.

British patent specification No. 431,394 discloses a racket in which the racket head is detachably mounted by elements is proposed in order to establish the desired angular position of the racket head relative to the handle. These resilient members or elastic members include springs or elastic strips or strings and should compensate for the reduced resiliency of the stringing at the racket head ends.

According to the British publication, two pivot pins define a common swivel axis, with a spring element being provided between the frames in the handle-near area in longitudinal direction of the racket, and the inner frame is allowed to carry out a rigid-body rotation about the axis of rotation of the pivot pins regardless of other existing flexibility of the racket parts. However, the handle-near spring element restricts the rigid-body rotation because during relative motion of the frames, the line of action of the compression-tension resiliency is directed toward the racket plane and thus a return moment about the axis of rotation is built up. Especially an assumed perfectly rigid racket head would perform a limited rigid-body rotation relative to the handle.

SUMMARY OF THE INVENTION

It is an object of the present invention to provide an improved racket for striking a ball obviating the aforestated drawbacks.

In particular, it is an object of the present invention to provide an improved racket for striking a ball with increased ball rebound capability, especially in direction to the crown, at reduced arm stress during and after ball impact.

These objects and others which will become apparent hereinafter are attained by hingedly connecting the inner stringed frame and the outer support frame via at least two joints which allow a local rotation of both frames relative to each other and prevent a translational movement of both frames in a direction perpendicular to the racket plane defined by the racket head, with the joints being arranged relative to each other such as to prevent the inner frame from carrying out a rigid-body motion relative to the outer frame.

Through the provision of a racket according to the invention, the type of permissible oscillations and pertaining eigenfrequencies can be influenced and precisely controlled by the arrangement and design of the joints. In particular, when isostatically supporting the inner frame in the outer frame, a selection of permissible and inadmissible oscillations of the subsytems and overall system is made, with the degrees of freedom in the individual joint and the arrangement of the points of articulation and relative arrangement of the effective axes of rotation significantly controlling the type and sequence of the dynamic modes and pertaining frequency range.

Even if the racket remains otherwise unaltered i.e. no changes to the inner and outer frames, a change in the configuration and arrangement of the joints causes significant changes in the vibrational behavior, frequency characteristics and thus in the overall response of the racket to an impacting ball. The frequencies transmitted from the inner frame during ball impact can be influenced such that bending oscillations parallel and lateral to the racket plane are decoupled so that the stringing is dynamically less stressed.

Through specific utilization of inherent mass damping of coupled vibrations, with consideration of the conservation laws governing the center of gravity, the effective masses are constructively defined according to arrangement and design of the joints and provided in optimum manner to ball and are now controlled more precisely and effectively by additional system parameters or degrees of freedom in accordance with the invention. The achievable absorption of post-vibrations exceeds the usual material-inherent value (about 3%), and particular amplitudes especially in the support frame are partially eliminated or suppressed.

A racket in accordance with the present invention is also characterized by the fact that during impacting of balls in the racket head center ("sweet spot"), the handle amplitudes are considerably lower than the inner frame amplitudes or are practically eliminated altogether as are the accelerations there.

In a racket according to the invention, the playing ability can be influenced to a greater degree not only by the basic shape and cross sectional profile of the racket, material selection and composition, but also through additional free system parameters such as number and arrangement of joints, design of the individual joint—e.g. pin-and-bushing connection or ball-and-socket joint—orientation of the effective axes of rotation relative to each other, profile of inner and outer frames, mass and stiffness ratios between inner and outer frames of the racket, because, in accordance with the invention, the elastic modes of the inner frame are linked with the elastic modes of the outer frame via a smaller number of constraints (e.g. isostatic).

In particular at ball-effective eigenmodes the position of oscillation nodes and antinodes can be shifted within a wider range than in conventional rackets.

Thus, the racket in accordance with the present invention attains a specialization by allowing the subsystems of inner and outer frames to perform different objectives and functions in space and time.

Oscillations which are not ball-effective can be reduced, through separation, to a lower energy level while ball-effective oscillations can be locally amplified in the impact areas for impulse recuperation.

The principle underlying the present invention and its realization have their analogies. For example, the inertia of water during hard impact is more likely to regain impulses that at moderate wave propagation (e.g. bouncing stone throw).

Compared with conventional rackets, the vibrational isolation and functional specialization in a racket according to the invention is somewhat similar to the difference between a rigid wheel axle and a single-wheel suspension (local shock and vibration absorption).

In a racket according to the invention, the spatial functional separation is attained through support of the joints which allows a relative motion between the frames with different objectives.

The different reaction in time during and after ball contact is attained through positioning of the relative supports and relative motion as well as through synchronization of mass and stiffness factors of inner and outer frames, with consideration of change in mass and center of gravity (and not only forces) during ball contact. Dynamic conditions are thus dynamically utilized by essentially utilizing otherwise harmful effects. In particular, a feature of a racket according to the present invention resides in the special use of impulse concentration and mass attenuation as well as in an increased decoupling of in-plane and off-plane racket oscillations, i.e. bending (torsional) vibrations parallel and perpendicular to the racket plane.

According to a preferred embodiment of a racket of the present invention, the inner stringed frame and the outer support frame are connected to each other in the crown area via one or two joints and in the area of the racket head between handle-near end and midsection via two to three further joints. In the event, one joint is provided in the crown area, two joints may be provided in the handle-near area to midsection, in order to create a three-point arrangement of joints. This configuration can also be reversed by changing the arrangement of the joints accordingly, with one joint in the handle-near area and two joints in the area of the racket head between midsection and crown.

An arrangement with four joints is attained by providing the racket head with a pair of joints in the upper racket head area as well as in the lower, handle-near racket head area. A variation is possible by providing only one joint in the upper head area as well as in the lower head area, with the other two joints opposing each other in the midsection.

Regardless whether the racket includes single-axis or multi-axis joints or a combination thereof, the joints may be designed in form of a bushing-pin connection or as a ball-and-socket joint. Single joint or all joints of the racket may be designed such that both frames may shift in axial direction at a respective point of articulation along a characteristic axis of rotation of the joint paralleling the racket plane. In accordance with the present invention, each individual joint may include a separate resiliently attenuating enclosure in order to absorb axial movements between the frames at the point of articulation.

According to one embodiment of the present invention, the racket head is provided with three joints, with each joint defining one axis of rotation and being arranged relative to each other such that the axes of rotation intersect upon the longitudinal axis of the racket. The point of intersection of the axes of rotation may lie within or outside the stringed inner frame area. By suitable positioning the joints and by suitable orientation of the axes of rotation, the point of intersection may be shifted along the longitudinal racket axis in order to constructively adjust the desired playing characteristics. The position of the point of intersection influences the position of the oscillation nodes and antinodes and thus can be utilized for ball-effective oscillation modes.

According to a second embodiment of a racket of the present invention, two or three joints are arranged such as to define two axes of rotation extending perpendicular to each other and being oriented in the racket plane, with one axis of rotation coinciding with the longitudinal racket axis. In this design, one joint is disposed in the crown of the racket head. In a configuration with two joints, the second joint is arranged in the handle-near area in opposition to the joint in the crown of the racket head. In a configuration with three joints, the second and third joints are arranged symmetrical to the longitudinal racket axis in the handle-near area to midsection of the racket head.

In accordance with a third embodiment of a racket of the present invention, in particular of a tennis racket, the hinged connection between inner and outer frames is provided by two, three or four joints, with two parallel axes of rotation lying in the racket plane and opposing each other in the upper head and lower head area. According to a first modification of this embodiment of a racket, two single-axis joints are arranged in the crown and handle-nearest point.

According to a second variation, one joint is arranged in the crown area and two further joints are disposed in the lower head area between the handle-near end and midsection of the racket head. A modification of the second variation includes shifting the joint in the crown area to the handle-near area. A variation with four joints includes pairwise arrangement of the joints in the upper and lower head area, with two axes of rotation intersecting the longitudinal racket axis within the stringed area.

According to a fourth embodiment of a racket in accordance with the present invention, the racket includes four joints, with two axes of rotation lying in the racket plane and extending perpendicular to each other and intersecting within the stringed head area. In a first variation of a racket of this type, both axes of rotation intersect in the center of the stringing area. In a second variation of a racket of this type, the point of intersection of the axes of rotation lies in the upper racket head area while according to a third variation, the point of intersection lies in the lower racket head area (handle-near area). All three variations may include an arrangement of joints with one axis of rotation coinciding with the longitudinal racket axis.

All embodiments as set forth above have in common that during ball impact upon the inner frame, impulse forces acting perpendicular upon the racket plane are directly transmitted as action forces via the pivot joint to the outer frame. In contrast to interposed spring or buffer elements, the racket according to the present invention attains a hard linkage between inner and outer frames, with the reaction forces of the inner frame contributing to a maximum impulse recuperation through impulse concentration in the hinged connections.

In view of the essentially unobstructed hinged connection of the double-framed racket head, both frames may locally rotate relative to each other and the elastic deformation energy can be essentially recovered for rebounding acceleration of the ball.

The self-oscillating behavior and the coupled oscillating behavior of inner and outer frames as well as the inertia masses and system-immanent antinodes and vibrational nodes which are utilizable for the rebounding acceleration of the ball can be controlled through selective arrangement of the joints and point of intersection of the pertaining axes of rotation. The present invention thus allows a variety of possibilities to control the racket and to tailor the playing abilities to the varying types of player and types of playing.

Experiences from computer simulation and practical tests have shown that the arrangement of the joints in the extreme areas of the racket head, i.e. crown and handle-nearest point, are preferred as a higher elasticity of the inner frame in the midsection up to the crown area with improved ball rebound is attained.

Moreover, it is advantageous, that balls which impact the upper racket head area generate in the crown joint higher reaction/action forces, with the impulse forces being transmitted to the outer frame via the entire length thereof and thus being absorbed to a greater degree.

Frames deflected in opposite direction (even during ball impact) of the coupled oscillation system result in a decreased deflection of the inner frame (conservation law of center of gravity) to thereby promote the ball impulse recuperation via inner tensional forces and and increased ability for inertia.

After ball contact, aftervibrations are absorbed by the presence of oppositely directed oscillations, with smaller amplitudes and smaller accelerations being encountered so that the player is basically free of strain. Practical tests have shown a more direct feeling for the ball at greater protection of the arm.

The teaching of the present invention is essentially based upon the principle of axis-controlled mass attenuation which is accomplished by increasing the effective masses and by axis-controlled initial conversion of the impact energy in recoverable bending deformation energy. Energies are locally concentrated to a greater degree and possible oscillation modes including stringing are influenced by the arrangement of the joints.

A difference between a racket according to the present invention and a double-framed racket with a plurality of spring-elastic elements or with single buffer elements resides in the fact that no absorption of impulse energy and oscillation energy is obtained in the transmitting elements at increased deformation/smaller expansion thereof. A residual damping in the joints is, however, desired as created e.g. through a metal-plastic combination of bolt (pin) and bush.

In the event a sliding motion of both frames relative to each other along the axes of rotation is permitted, oscillations and deformations of the inner frame in the racket plane need not necessarily be transmitted to the outer frame. Decoupled deformation energy in the racket plane is anyway hardly utilizable for ball rebound and thus can be axially destroyed in accordance with the present invention by at least one axially elastic element which loosely or in sleeve-like manner surrounds the axis of rotation of the joint. In particular multi-axis bending oscillations are most inconvenient for a player.

Moreover, a deformation of the outer support frame in its plane is transmitted to the inner frame via the axial mobility to a lesser degree and only at certain points so that the stringing is protected through decreased oscillations in its plane and the economic efficiency and the playing ability is improved.

The positive effects of partial vibrational decoupling in dependence on the design of the racket are especially of relevance when supporting the stringed inner frame in the outer frame isostatically i.e. without restraints.

A racket in accordance with the present invention accomplishes a number of advantages and effects which can be summarized as follows:

1. The ball rebound in a wide range of the stringing is improved, including the area of the point of intersection of the axes of rotation and the midsection and upper racket head area as well as in the lateral marginal areas of the inner frame between midsection and crown (exceptional ball accelerating areas).

2. Moderation in the handle-area as the maximum oscillation amplitudes are shifted away from the grip at impact.

3. Elimination of aftervibrations in the handle area, with the handle amplitudes being completely eliminated at certain oscillation modes.

4. The outer support frame and the inner stringed frame perform particular functions by means of pivot joints with a minimum of restraint. This is best understood by comparing the difference between a rigid wheel axle and a single-wheel suspension where the principle of a local limitation of impacts finds its analogy.

When providing a racket head with two axes of rotation with concentration of the reaction forces in the upper head area and midsection at otherwise identical shape and cross sectional profile, the flexibility of the inner frame is the greatest. A racket of this type is in particular advantageous for lightweight players.

The bi-axial arrangement of the three joints attains similar flexibility, with both axes of rotation intersecting perpendicular approximately in the lower stringed racket head area and defining for certain eigenfrequencies an oscillation node whereby in the surrounding area thereof impacting balls are rebounded at superior acceleration through impulse concentration (wave propagation).

A preferred embodiment of the present invention includes three axes of rotation with three joints. Both mirror-symmetrical joints are located in the lower racket head area. The axes and their orientation are selected such that the point of intersection of the three axes of rotation is disposed in the lower area to midsection of the racket head. In this embodiment, the impulse forces concentrate in the point of intersection. If being shifted to the sweet spot, the point of intersection coincides with the area of maximum flexure of the inner frame. Depending on frequency/eigenmode, this area includes pronounced antinodes or oscillation nodes. The three axes of rotation define three different areas of stringing.

Rackets with three joints or with two pivot joints were tested primarily dynamically through FEM-computer simulation, modelled both by beam or shell elements.

In addition to modal analyses, impact/time-history analyses were performed in order to simulate and analyze the characteristic behavior of the racket during varying types of ball impact. Additionally conforming prototypes have undergone playing tests using functional models. It has been shown that a suitably designed racket in accordance with the present invention can be made in conventional weight classifications of about 350–390 g total weight. Through mass adjustment in the handle area, the location of the center of gravity corresponds essentially to conventional rackets.

For illustrative purposes, reference is made to an exemplified racket with three joints. The referred-to lengths data "xsi" are—starting from the handle end—relativated with the total length "L".

| | |
|---|---|
| Total mass: | m = 370 g, |
| Total length: | L = 680 mm |
| Mass ratio of outer frame to inner frame: (without mass alignment, stringing, grip band) | f = 2.5 |
| Center of gravity of racket: | xsig = 0.56 |

-continued

| | |
|---|---|
| Center of gravity of outer frame: | xsia = 0.49 |
| Center of gravity of inner frame: | xsii = 0.75 |
| Principal moments of inertia: | I1:I2:I3 = 7.5:6.5:1.0 |
| Outer frame frequencies 1–5: | 155, 181, 193, 397, 473 Hz |
| Inner frame frequencies 1–5: | 317, 322, 449, 455, 876 Hz |
| Racket frequencies 1–5: | 171, 181, 244, 277, 365 Hz |
| Mass ratios of both frames testes so far: | 1.5–2.5. |

BRIEF DESCRIPTION OF THE DRAWING

The above and other objects, features and advantages of the present invention will now be described in more detail with reference to the accompanying drawing in which:

FIGS. 1*a* and 1*b* are a schematic top elevational view and a perspective view of one embodiment of a racket in accordance with the present invention;

DETAILED DESCRIPTION OF PREFERRED EMBODIMENTS

Figure 2A:
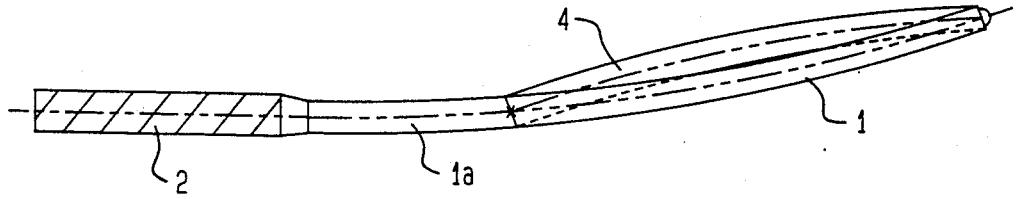
FIGS. 2*a* to 2*c* are illustrations of typical fundamental modes of oscillations of the racket illustrated in FIGS. 1*a* and 1*b;*

Throughout all the Figures, the same or corresponding elements are indicated by the same reference numeral.

Referring now to the drawing and in particular to FIG. 1*a*, there is shown a plan view of one embodiment of a racket for striking a ball in accordance with the present invention. The racket includes a generally oval-shaped racket head generally designated by reference numeral 100 and comprised of a closed inner frame 4 with stringing 3 and an outer support frame 1 which at least partly surrounds the inner frame 4. Opposite to the crown of the racket head 100, the outer frame 1 is continued in one piece by a bifurcated throat 1*a* which is connected to a handle 2 for gripping by a player.

As schematically indicated in FIG. 1*a*, the outer frame 1 is hingedly connected to the inner frame 4 via three joints 5, with one joint 5 being arranged in the crown of the racket head 100 and with the other two joints 5 being arranged in the handle or grip near area of the racket head 100 in opposition to each other. Each joint 5 defines an axis of rotation 7 and may be designed in any suitable manner as will be described furtherbelow.

In the nonlimiting embodiment of FIG. 1*a*, the three axes of rotation 7 intersect in a point of intersection A which is located in the handle-near area of the racket head 100 and lies upon the longitudinal axis L as defined by the racket head 100. As can be seen from FIG. 1*a*, the two axes of rotation 7 in the handle-near area of the racket head 100 are slantingly oriented, with the axis of rotation 7 of the joint 5 in the crown coinciding with the longitudinal racket axis L.

FIG. 1*b* shows a perspective view of the racket, illustrating in detail a possible cross sectional profile of the racket 100, with the inner frame and outer frame complementing each other to create a visually appealing unit thereof.

Figure 2B:
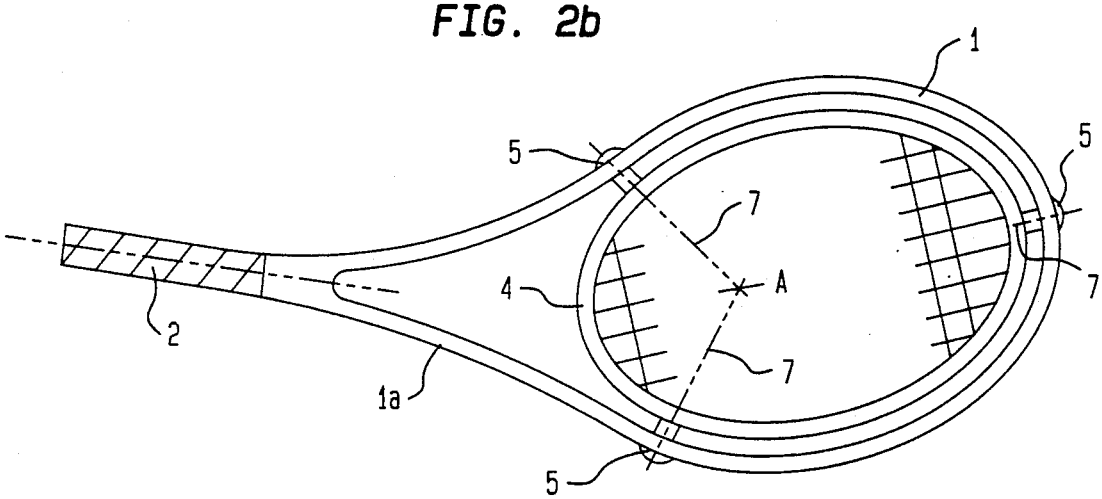
Figure 2C:
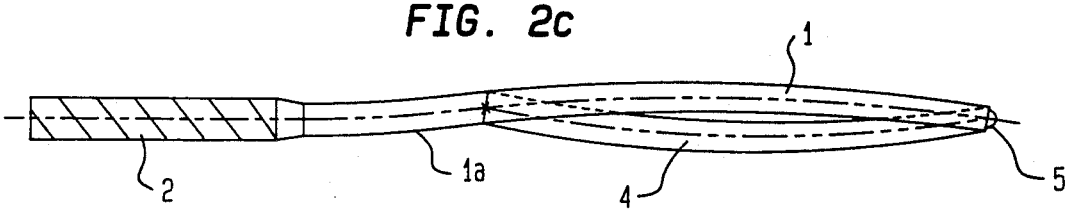

Turning now to FIGS. 2*a* to 2*c*, there are shown various illustrations of typical fundamental modes of oscillations of the racket 100 during impact of a ball. FIG. 2*a* depicts a fundamental mode of oscillation, with the outer frame 1 and integral handle 2 including two oscillation nodes (symmetric bending) while the inner frame 4 executes an opposing symmetrical flexure relative to the outer frame 1 via the joints 5. Both inner frame 4 and outer frame 1 are deformed in such a manner that the overall center of gravity remains in the racket plane.

FIG. 2*b* illustrates the next higher "in plane" fundamental mode of oscillation in the racket plane, with both frames 1, 4 undergoing an elastic flexure. Depending on the design of the joints 5, this mode of oscillation permits a relative axial motion between both frames 1, 4 in the area of the joints 5.

FIG. 2*c* shows a higher dynamic bending mode of the racket transversely to the racket plane. The outer frame 1 undergoes a quasi-antimetric flexure with three nodal points of oscillation, while the inner frame 4 is deflected symmetrically and in opposite direction via the joints 5 at this mode of oscillation. This fundamental oscillation is preferably generated at e.g. centrally impacting balls, with the handle 2 being subjected to only a relatively slight deflection so that forces or vibrations affecting the player are substantially reduced.

FIGS. 3*a* to 3*d* show graphical illustrations of the resonance curves of the racket as depicted in FIGS. 1*a* and 1*b* during central impact, with the deformation of the racket being shown in FIG. 2*c*. In the graphs, the x-coordinate depicts the time over a time range of 0.8 seconds with 80 time steps and impressed pulse function, and the y-coordinate depicts the deflection. The attenuated curves of oscillation were obtained through FEM computer simulation upon impact in the center of the racket head 100.

Figure 3A:
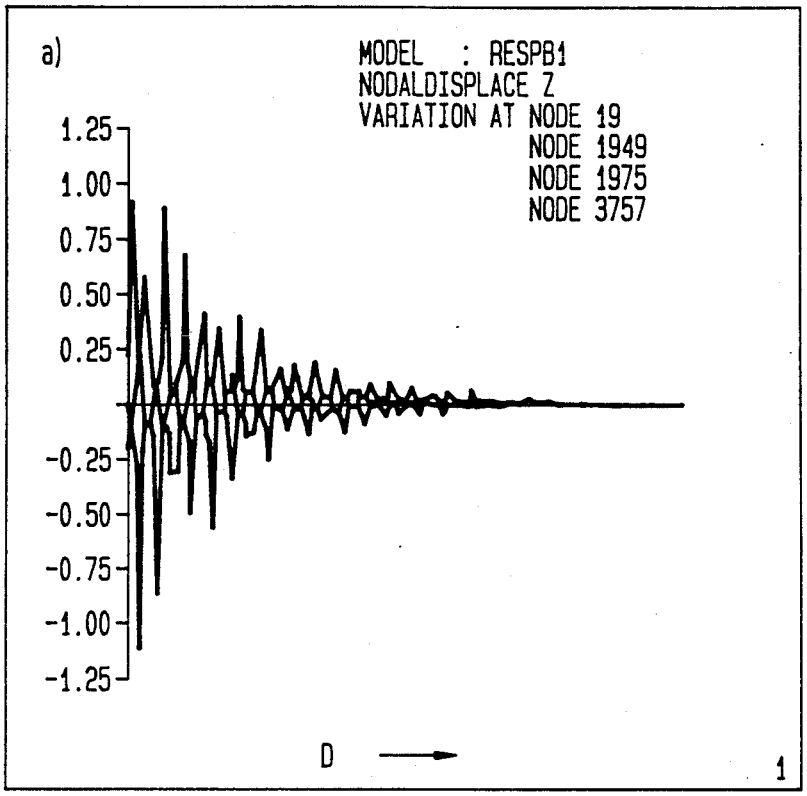
FIGS. 3*a* to 3*d* are graphical illustrations of resonance curves of the racket of FIGS. 1*a* and 1*b* during central impact, with FIG. 3*a* illustrating lateral oscillation at selected nodes, FIG. 3*b* illustrating longitudinal oscillation at the selected nodes, FIG. 3*d* illustrating transverse oscillation at the selected nodes, and FIG. 3*c* illustrating positions of the selected nodes.
Figure 3B:
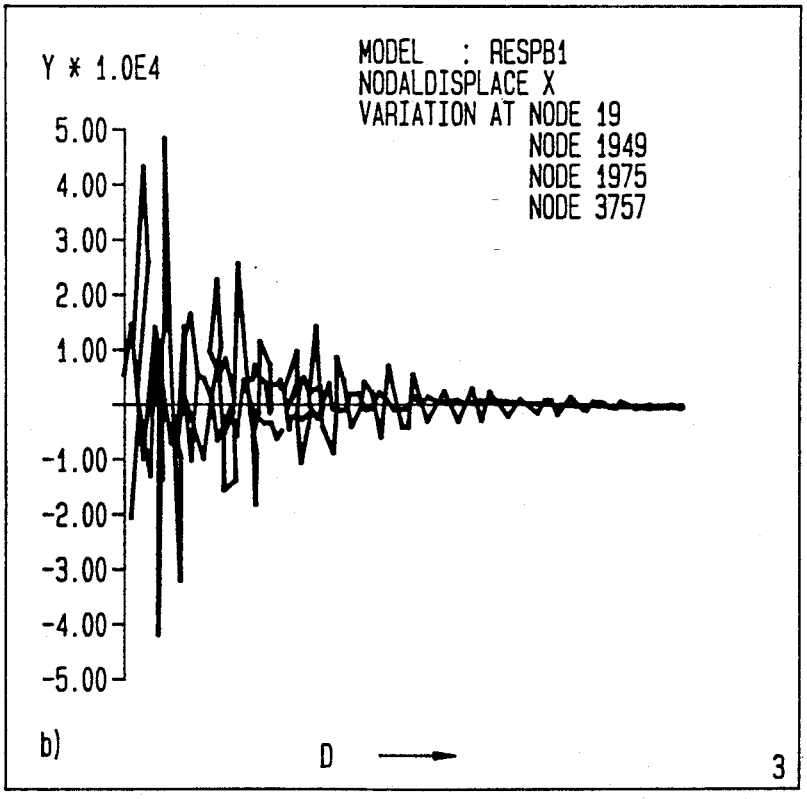

FIG. 3*a* illustrates an initial transversal deflection (z) of −1.1 mm, while FIG. 3*b* shows the longitudinal deflection (x) in the racket plane being smaller by four powers of ten and thus practically negligible. The same is true for the "in plane" deflection (y) in transverse direction as illustrated in FIG. 3*d* and being smaller by three powers of ten.

The resonance curves according to FIGS. 3*a,b,d* have in common that the fundamental oscillation as shown in FIG. 2*c* is excited and that the dying out of the generated oscillation is improved, i.e. the oscillation fades to a greater degree as otherwise obtained through material properties.

Figure 3C:
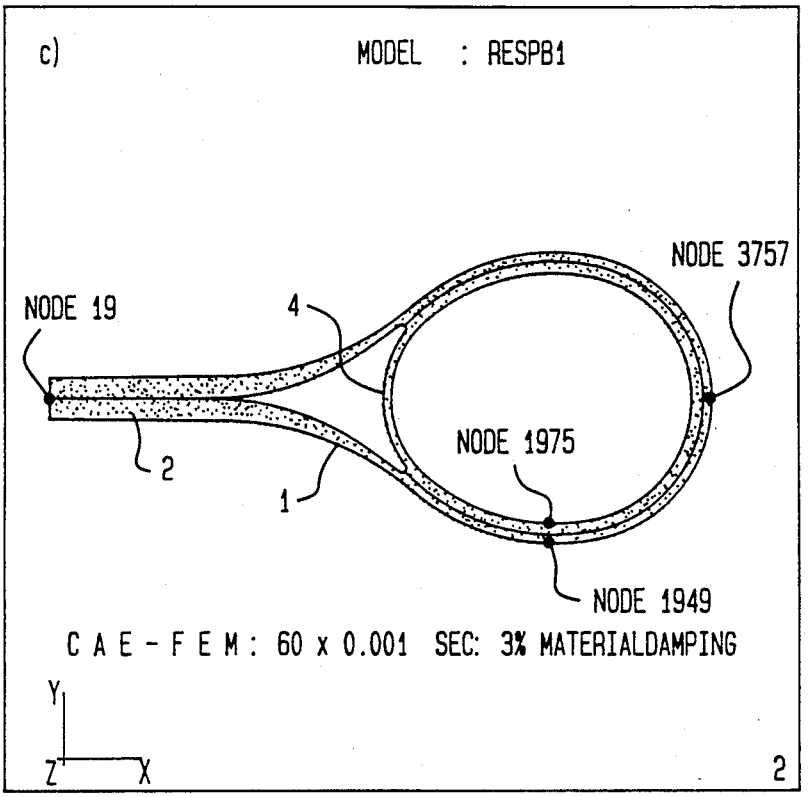
Figure 3D:
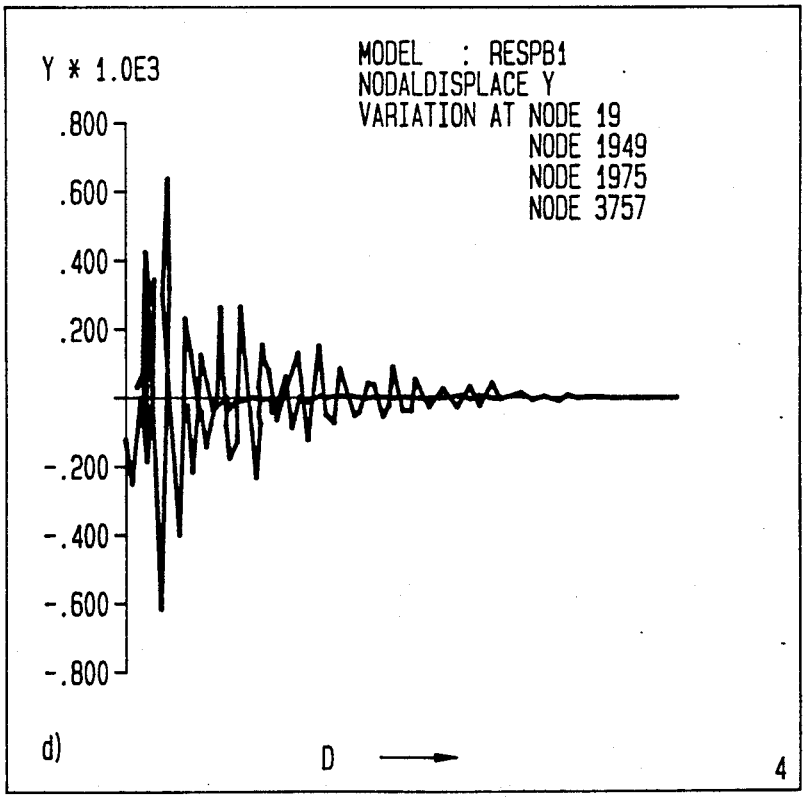

FIG. 3*c* illustrates selected representative nodes of the racket head 100, with node 19 at the grip end, node 3757 at the crown, node 1949 at a central location of the outer frame 1, and node 1975 at a central location of the inner frame 4. The deflection or oscillation of the racket head 100 in these nodes is illustrated in FIGS. 3*a,b,d*.

Figure 4A:
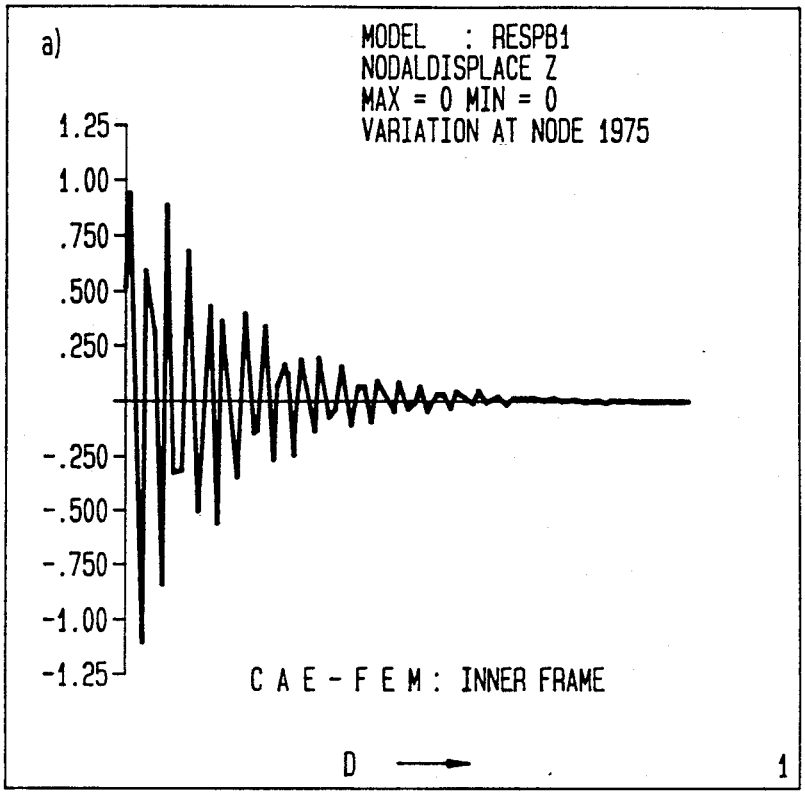
FIGS. 4*a* to 4*d* are graphical illustrations of resonance curves of the racket of FIGS. 1*a* and 1*b* during central impact for lateral oscillation, with FIG. 4*a* showing oscillation amplitudes at center-side of inner frame, FIG. 4*b* showing oscillation amplitudes as center-side of outer frame, FIG. 4*c* showing oscillation amplitudes at grip end, and FIG. 4*c* showing impact at outer frame crown.
Figure 4B:
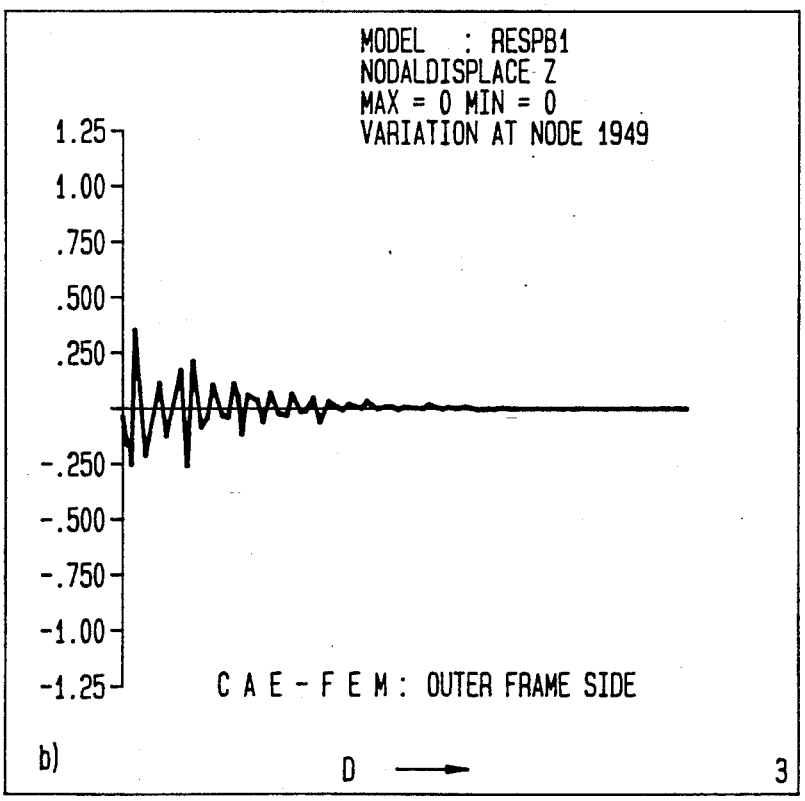
Figure 4C:
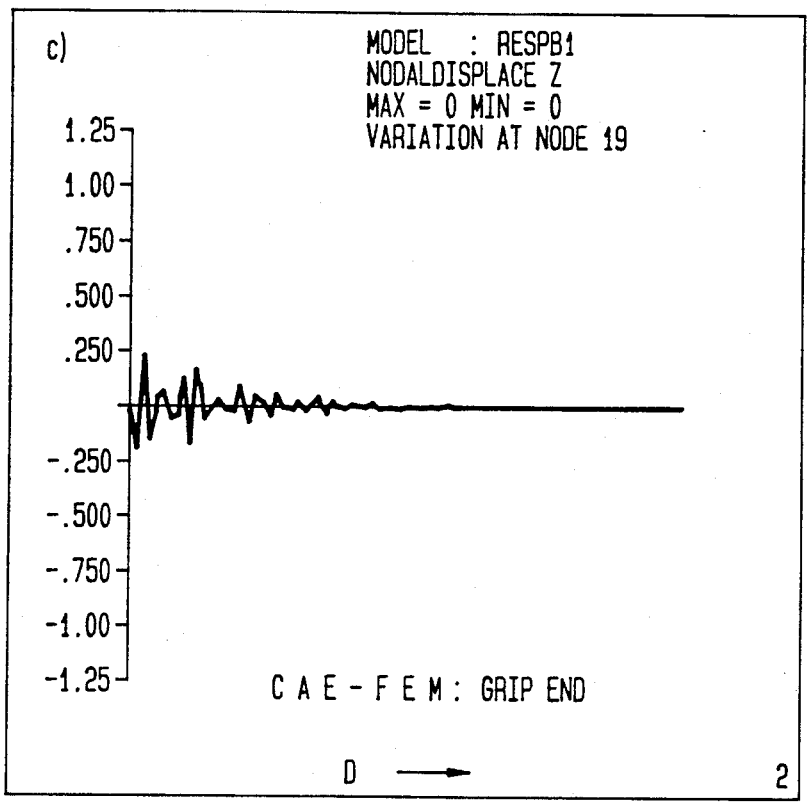
Figure 4D:
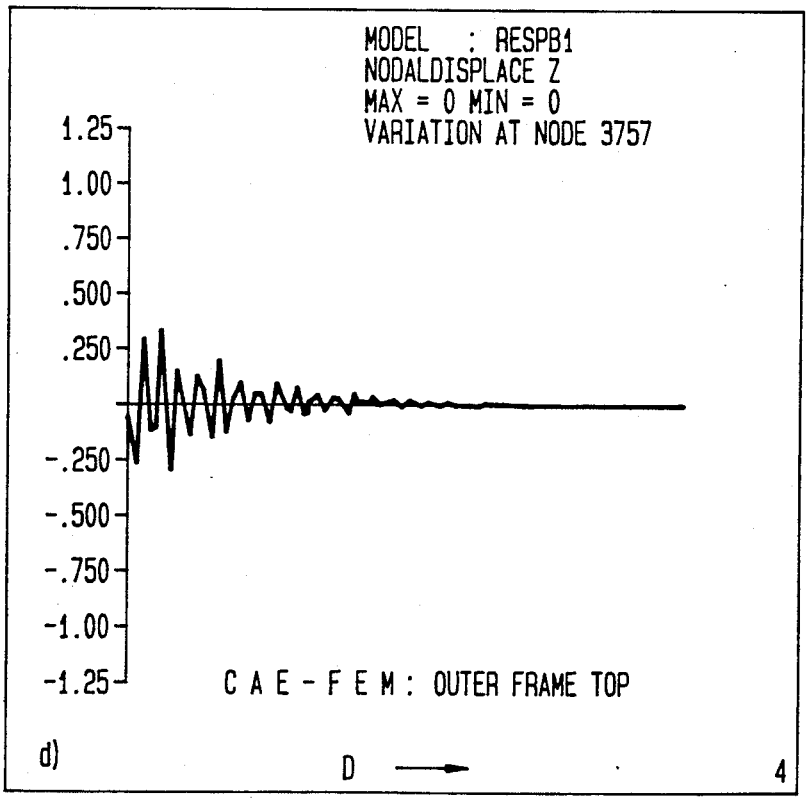

Turning now to FIGS. 4*a* to 4*d*, there are shown graphical illustrations of the resonance curves of the racket of FIGS 1*a* and 1*b* during central impact for transversal oscillations (z) according to FIG. 3*a*. FIG. 4*a* illustrates the deflection of the racket head 100 over the time for the node 1975, and it can be seen that the inner frame 4 has maximum oscillation amplitude (100%). FIG. 4*b* shows the deflection at neighboring outer frame node 1949 which is opposite to node 1975, with about 25% of the maximum oscillation amplitude of the inner frame 4. FIG. 4*c* which shows the oscillation in node 19 at the handle end indicates that the oscillation amplitude is further reduced. The same is true for the deflection in node 3757 at the crown of the racket head.

Figure 5:
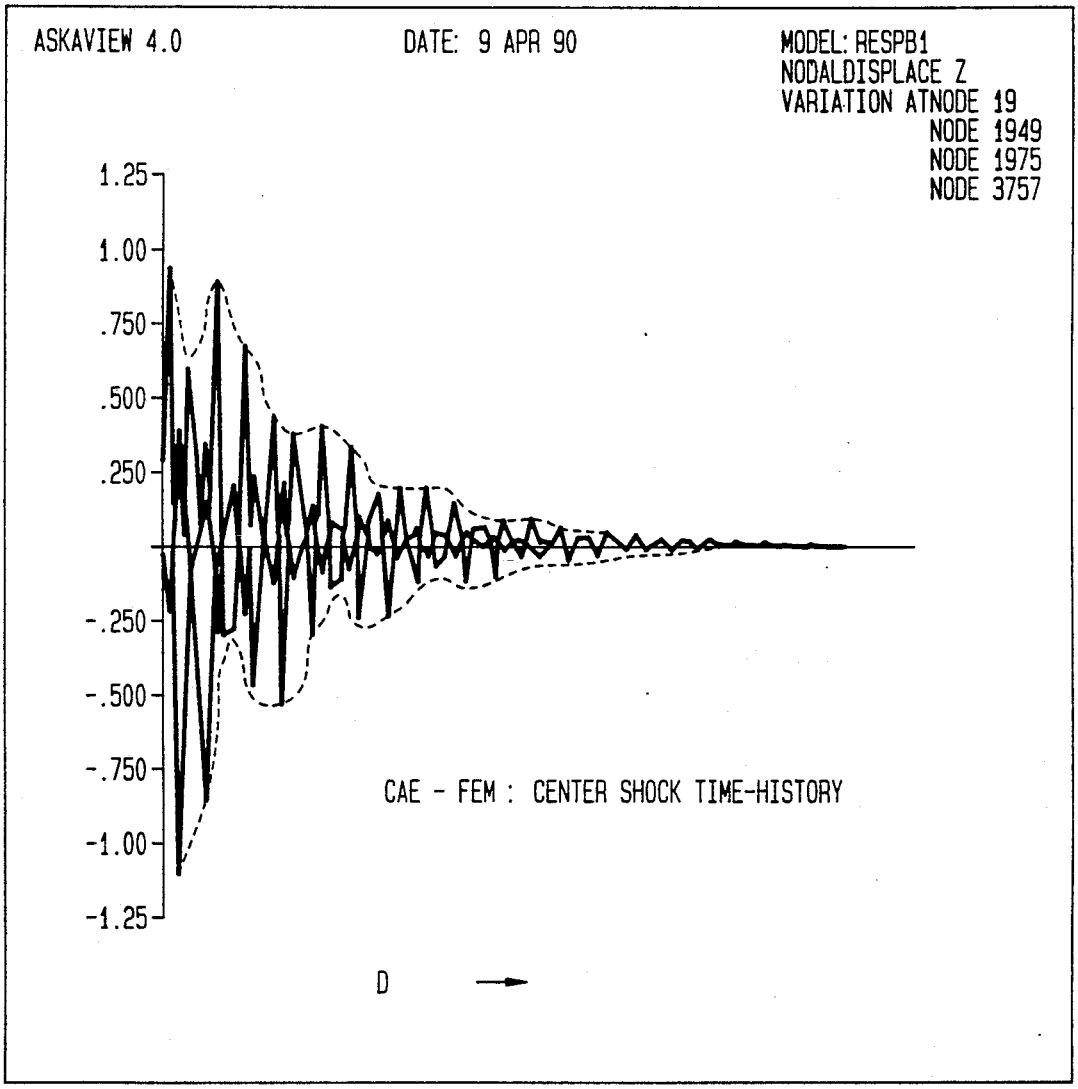
FIG. 5 is a graphical illustration, on an enlarged scale, of the combined resonance curves according to FIGS. 4*a* to 4*d* for the grip end, crown, mid-sides of inner frame and outer frame for the coupled oscillating system.

FIG. 5 shows, on an enlarged scale, the illustration of FIG. 3*a* and constitutes a compound graphical illustration of the transverse oscillations of FIGS. 4*a* to 4*d*. The direct comparison indicates the varying decreases of the amplitudes in the selected nodes over the time period. FIG. 5 clearly indicates the opposite phases of the oscillations of inner frame 4 and outer frame 1 as well as the identical zero crossing and the exponential fading of the oscillations, superimposed by moderate beats of about a quarter of the frequency of resonance.

Referring now to FIGS. 6*a* to 6*d*, there are shown schematic plan views of various embodiments of a racket in accordance with the present invention.

Figure 6A:
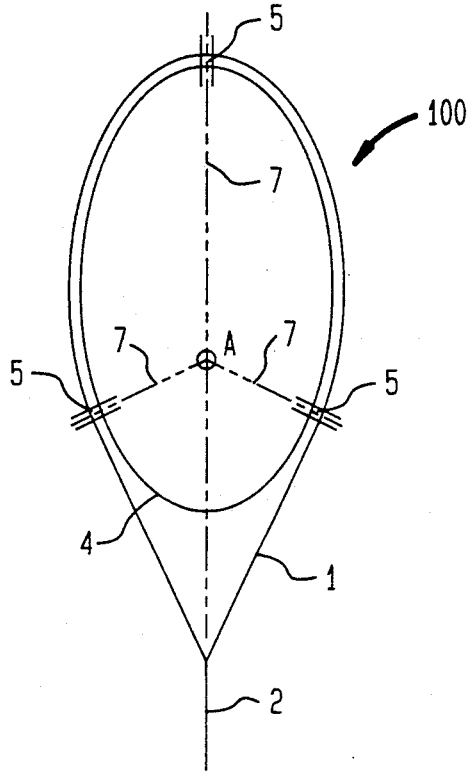
FIGS. 6*a*–6*e* are plan views of various embodiments of a racket in accordance with the present invention with varying number of joints and axes of rotation.

FIG. 6*a* shows a schematic plan view of the racket of the type illustrated in FIGS. 1*a* and 1*b*, with the joints 5 describing three axes of rotation 7 which traverse the racket head 100 substantially perpendicular and intersect in a point of intersection A located in the handle-near area of the racket head 100.

Figure 6B:
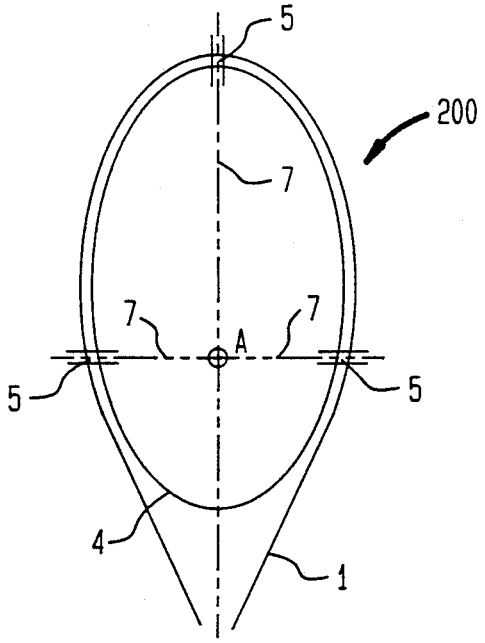

FIG. 6*b* shows a second embodiment of a racket in accordance with the present invention, with a racket head 200 which differs from the racket head 100 by the arrangement of the joints 5 in the handle-near area which define coinciding axes of rotation 7 so that two perpendicular axes of rotation 7 intersect in point of intersection A.

Figure 6C:
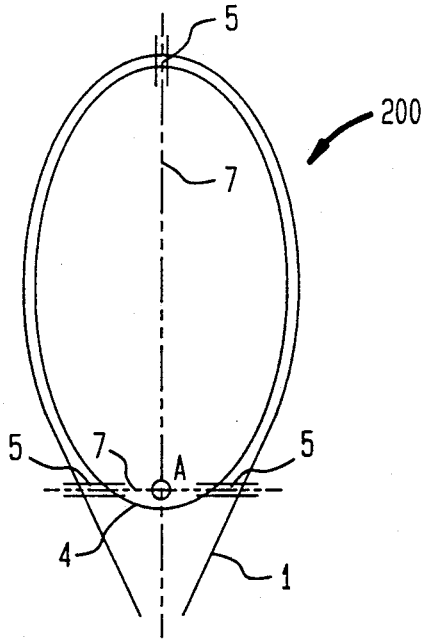

FIG. 6c shows a variation of the type of racket illustrated in FIG. 6b and includes the racket head 200 in which the handle-near joints 5 are further shifted to the throat or crown distant area of the racket so that the point of intersection A is now located in the marginal area of the racket head 200. Otherwise, the configuration of the axes of rotation 7 corresponds to the configuration of the axes of rotation as illustrated in FIG. 6b, i.e. two perpendicular axes of rotation 7 with the point of intersection A lying on the longitudinal axis of the racket head which axis coincides with the axis of rotation 7 extending through the joint 5 in the crown of the racket head.

The racket head 200 can be modified in such a manner that the opposing joints 5 in the handle-near area approach each other such that in the extreme case, the joints 5 quasi coincide, with the racket head 200 including only two joints 5, with one joint 5 arranged in the crown area and one joint 5 arranged in the throat area and defining an axis of rotation extending tangential to the inner frame 4.

Figure 6D:
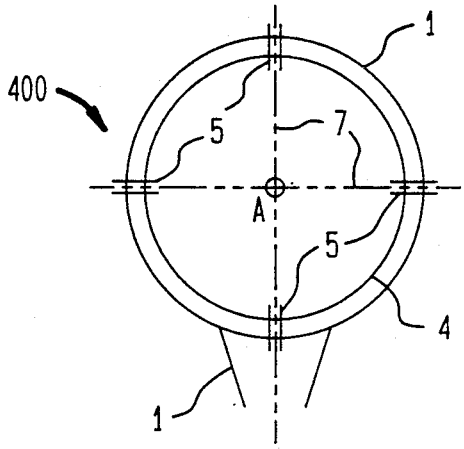

FIG. 6d illustrates a generally round racket head 400 with four joints 5 which are uniformly spaced about the perimeter so as to define two perpendicular axes of rotation 7 intersecting in a common point of intersection A which constitutes the center of the racket head 400. In the example of FIG. 6d, two joints 5 are arranged in the longitudinal axis of the racket head 400 at the extreme ends, i.e. at the crown and the opposing lower end of the racket head, and the other two opposing joints are spaced therefrom by an angular distance of 90°.

Figure 6E:
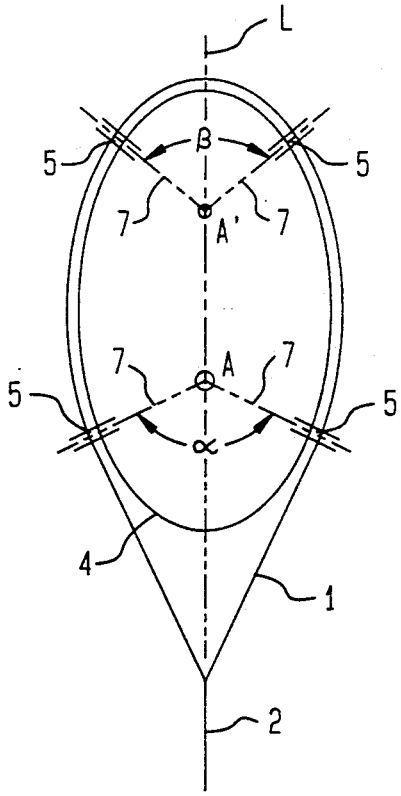

A modification of the racket head 100 as shown in FIGS. 1a and 6a is schematically illustrated in FIG. 6e in which the single joint 5 in the crown area of the racket head 100 in FIG. 6a is now replaced by two joints 5 essentially corresponding to the joints 5 in the handle-near area. The crown-near joints 5 define two axes of rotation 7 which are slantingly oriented and intersect in the upper racket head area in vicinity of the crown the longitudinal axis L in a common point of intersection A'. An angle $\beta$ is defined between the axes of rotation 7 of the crown-near joints 5, and an angle $\alpha$ is defined between the axes of rotation 7 of the handle-near joints 5, with angles $\alpha$ and $\beta$ being greater or smaller than 90°.

Figure 7:
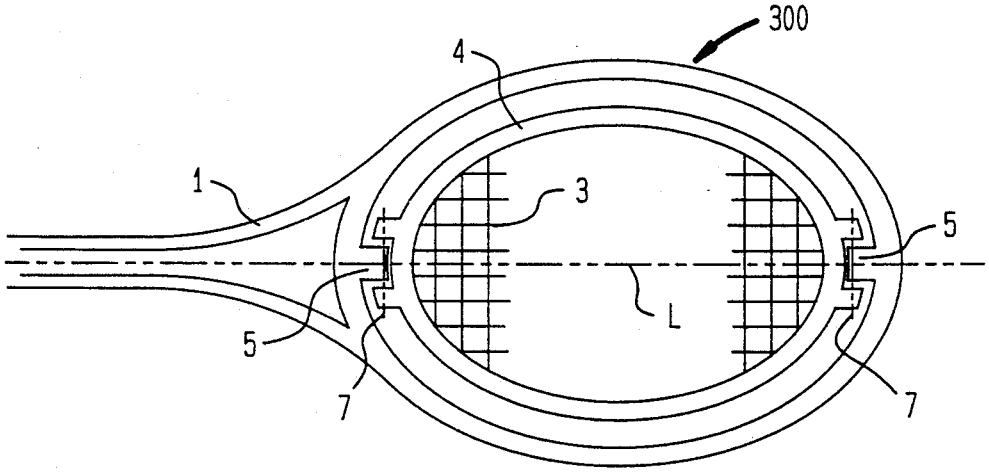
FIG. 7 is a plan view of a further embodiment of a racket according to the present invention with two joints and two parallel axes of rotation.
Figure 8:
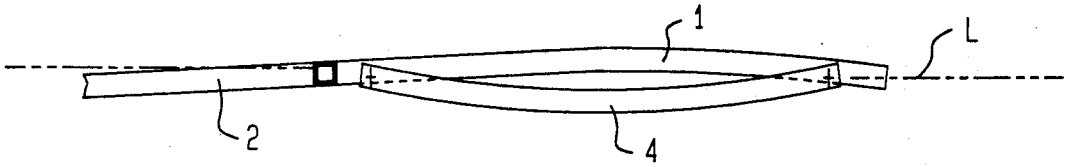
FIG. 8 is a schematic illustration of the racket of FIG. 7, showing a typical mode of oscillation.

FIG. 7 shows a further embodiment of a racket in accordance with the present invention, including a racket head 300 in which the inner frame 4 is completely surrounded by the outer frame 1. The inner frame 4 and the outer frame 1 are hingedly connected to each other via two joints 5, with one joint 5 being in the crown area and the other joint 5 in the opposing lowermost end or handle-nearest area of the racket head 300. The joints 5 define two parallel axes of rotation which extend perpendicular to the longitudinal axis L of the racket head 300. As can be seen from FIG. 8, at particular frequencies, the outer frame 1 with handle 2 and the inner frame 4 deflect in opposite direction. FIG. 8 also shows that during a flexure of the inner frame 4, the outer frame 1 is contracted in direction of the longitudinal axis so that the outer frame 1 stores elastic deformation energy which can be fed back, and the inner frame 4 is prevented from an increasing deformation. The subsequent relaxation of the outer frame 1 exerts accelerating forces upon the inner frame 4 which also relaxes, with this relaxation being converted in additional kinetic ball energy. A racket with racket head 300 according to FIG. 7 shows also superior ball rebound ability.

Figure 9:
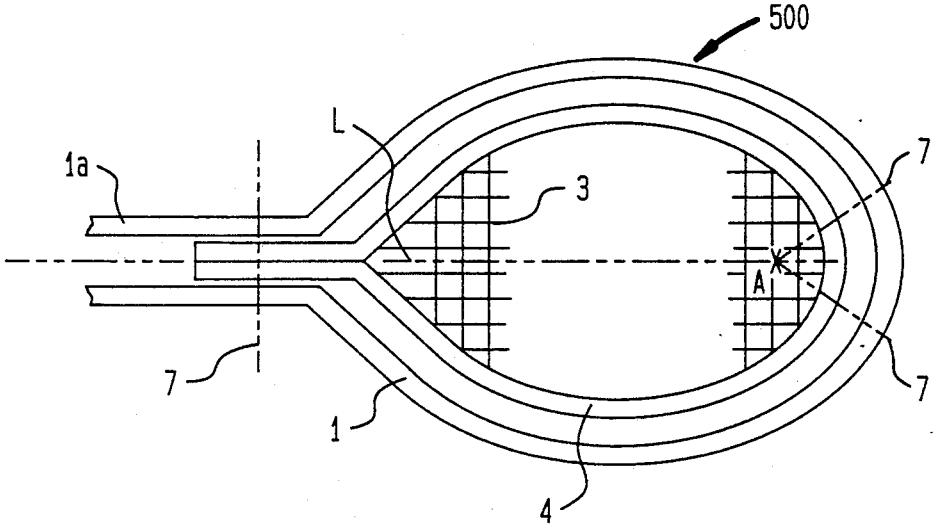
FIG. 9 is a plan view of another embodiment of a racket according to the present invention with three joints and three axes of rotation.

Turning now to FIG. 9, there is shown another embodiment of a racket in accordance with the present invention. The racket includes a racket head 500 in which the outer frame 1 and the inner frame 4 are hingedly connected by two joints 5 which are arranged in the upper racket head area in vicinity of the crown and define axes of rotation 7 extending at an acute angle to the longitudinal axis L, and by one joint 5 which is arranged in the bifurcated throat area la and defines an axis of rotation 7 extending perpendicular to the longitudinal axis L. In contrast to the previously described embodiments of a racket in accordance with the present invention, the axes of rotation 7 as defined by the joints 5 intersect in a common point of intersection A which is defined by the intersecting axes of rotation of the crown-near joints 5 and is located upon the longitudinal axis L.

Figure 10:
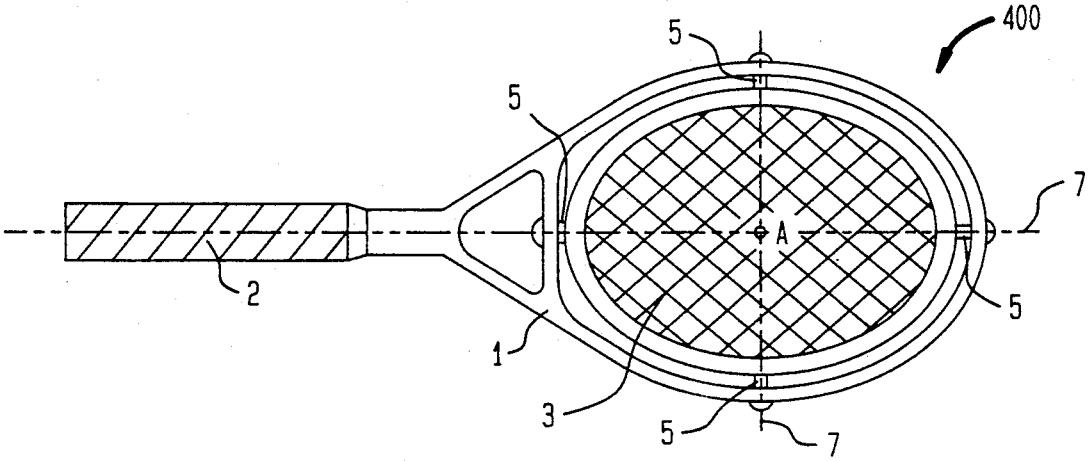
FIG. 10 is a plan view of a variation of the type of a racket shown in FIG. 6*d* with four joints and two axes of rotation.

FIG. 10 shows a modification of the type of a racket as illustrated in FIG. 6d and includes a generally oval-shaped racket head 400 with joints 5 configured as single-axle pivots in form of a pin joint, with both axes of rotation 7 extending perpendicular to each other and intersecting approximately centrally in the point of intersection A.

Figure 11:
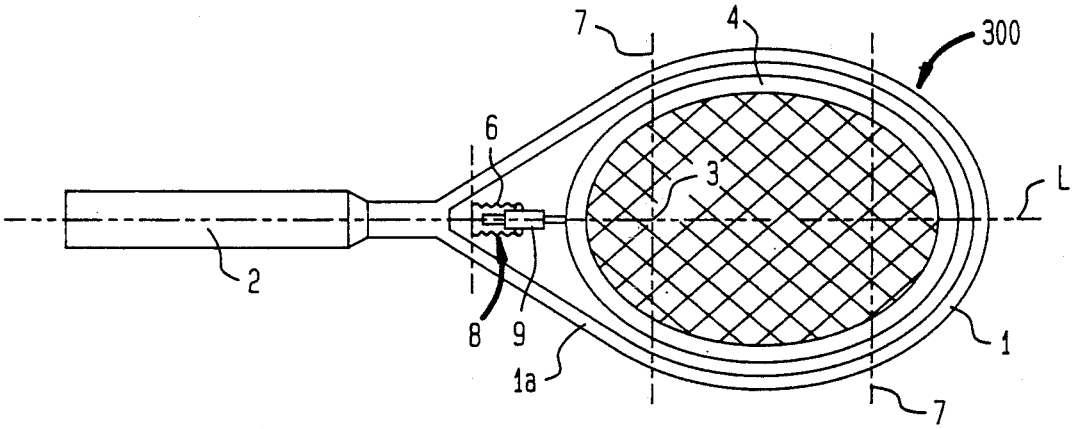
FIG. 11 is a plan view of a variation of the type of a racket shown in FIG. 7 with four joints and two axes of rotation.

In FIG. 11, there is shown a variation of the type of racket shown in FIG. 7, with a racket head 300 whose inner frame 4 is connected with the outer frame 1 via two pairs of opposing joints (not shown) whereby each pair of joints define a common axis of rotation 7. Both axes of rotation 7 extend parallel and perpendicular to the longitudinal axis L of the racket head 300 and also extend within the area enclosed by the inner frame 4 approximately in the respective crown-near or throat-near section of the racket head length. As further shown in FIG. 11, the inner frame 4 is connected in the bifurcated throat area la of the racket head 300 with the outer frame 1 via a spring-type damping element generally designated by reference numeral 8. The spring-type damping element 8 includes a pneumatic or hydraulic altimeter 9 and two springs 6 and is articulated to both frames 1, 4 to define respective axes of rotation which parallel the axes of rotation 7.

Figure 12:
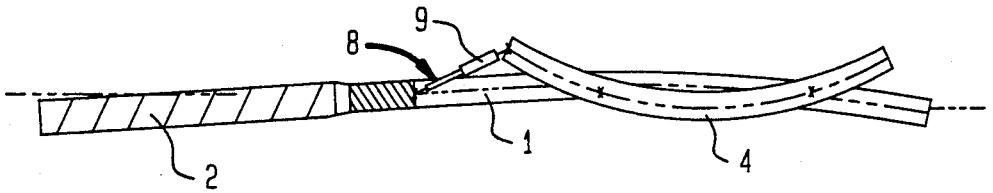
FIG. 12 is a schematic illustration of the racket of FIG. 11, showing a mode of oscillation.

FIG. 12, which shows a side view of the racket 300 after being impacted by a ball, clearly illustrates the relative deflection of both frames 1 and 4.

Figure 13:
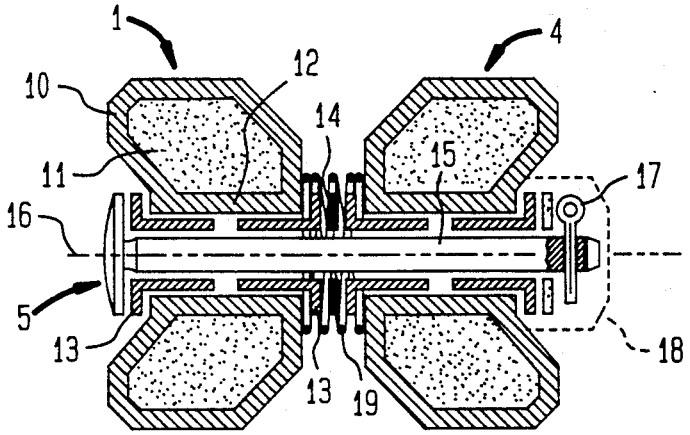
FIG. 13 is a sectional view of one exemplified design of a joint utilized in a racket according to the present invention.

Turning now to FIG. 13, there is shown a sectional view of an exemplified pivot joint 5 which allows a rotation of the inner frame 4 relative to the outer frame 1 about the joint axis and allows a limited axial displacement along the joint axis. Both frames 1, 4 include an outer shell 10 and an inner foam core 11. In the area facing the pivot joint 5, each frame 1, 4 is reinforced by a T-shaped cylindrical member 12 which connects the outer and inner wall section of the outer shell 10 of each frame 1, 4. The pivot joint 5 includes a bolt or pin 15 which traverses the inner and outer frames 4, 1 and is supported in each frame 4, 1 by a pair of bearing bushes 13 which are sandwiched between the bolt 15 and the respective cylindrical members 12. Arranged between the inner facing bearing bushes 13 is at least one spacer disk 14. Through appropriate selection of thickness and number of spacer disks 14, the distance between opposing bearing bushes 13 can be controlled and the prestress can be adjusted.

The bolt 15 is provided at the end projecting beyond the outer frame 1 with a flattened head 16 which bears against the flanged end of the respective bearing bush 13. The other end of the bolt 15 extends beyond the inner frame 4 and is provided with a throughhole traversed by a cotter 17 for axially securing the joint. It will be appreciated that other safety assemblies may be utilized such as snap ring or the like. Indicated by broken line is a cap 18 which may be provided to cover the inner bolt end and the cotter 17.

Tests have shown, however, that an axial safety bolt arrangement may be omitted through suitable fit, axial alignments and possible prestress.

The length of the bolt 15 is selected in such a manner that upon flexure in the racket plane as e.g. upon longitudinal oscillations, the inner frame 4 and/or outer frame 1 may shift through transverse contraction in longitudinal direction of the bolt so that forced deformations can be reduced.

As is further shown in FIG. 13, a combined tensile and compressive spring 19 or a respectively enclosing elastomer may be arranged at the opposing sides of inner and outer frames 4, 1 in order to improve their axial fit and to provide a supporting and damping effect between the frames 1, 4. It will be appreciated by persons skilled in the art that the provision of such a spring 19 is not necessarily required.

Figure 14:
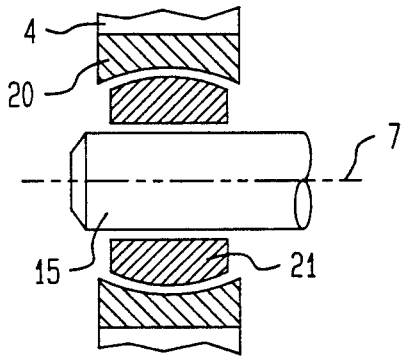
FIG. 14 is a fragmentary sectional view of an exemplified design of a pivot joint.

FIG. 14 shows a simplified illustration of a portion of a pivot joint 5 with three axes of rotation 7 extending perpendicular to each other, whereby only one axis of rotation 7 is shown and coincides with the axis of the bolt 15 (e.g. the bolt 15 according to FIG. 13). The illustrated portion of the joint includes an inwardly spherical-shaped bushing 20 which is fit in the inner frame 4, and a barrel-shaped swivel ring 21 which is disposed between the bushing 20 and the bolt 15 and is allowed to swivel in the bushing 20. The bolt 15 traverses the swivel ring 21 such as to slide within the swivel ring 21 along the axis of rotation without any significant play.

It will be appreciated by persons skilled in the art that the joint with three rotational degrees of freedom as shown in FIG. 14 may be substituted by other joints in order to meet the basic concept of the present invention, such as e.g. a ball-and-socket joint. Also, it should be considered within the scope of the present invention to provide a joint which allows the player to modify the orientation of the axis of rotation 7 in order to adjust the frequencies and thus the behavior to different types of stringing. A possible design of a joint may include a screw for locking the bushing 20 and the swivel ring 21 so that the bolt 15 and thus the axis of rotation 7 can be selectively aligned.

Figure 15:
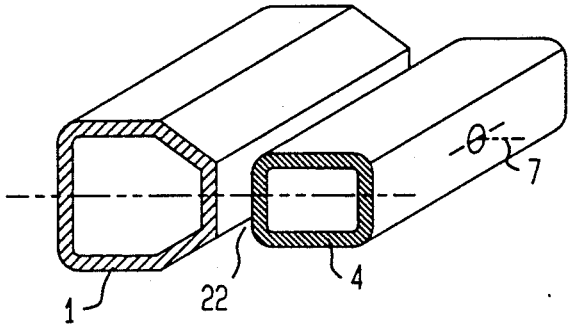
FIG. 15 illustrates a fragmentary perspective illustration, partially sectional, of the inner and outer frame of a racket according to the present invention.

In FIG. 15, an exemplified cross sectional profile of the inner and outer frames 4, 1 is shown, with the inner stringed frame 4 having a elongated and flat cross section in the racket plane and the outer support frame 1 having a greater structural height than the inner frame 4 transversely to the racket plane. Thus, the outer frame 1 is stiffer and more resistant to bending in direction perpendicular to the racket plane while the inner frame 4 is stiffer and more resistant to bending in the racket plane. It has been shown that due to its lengths dimension, the outer frame 1 with handle 2 is far more subjected to bending in a direction perpendicular to the racket plane than the inner frame 4 which is primarily subjected to bending forces in the racket plane.

At its inner side facing the inner frame 4, the outer frame 1 is slanted so that the gap 22 between the inner and outer frames 1, 4 displays aerodynamically favorable conditions for reducing the air resistance of the racket in direction perpendicular to the racket plane.

It will be appreciated that the nonlimiting embodiment of the inner and outer frames 4, 1 with air gap 22 as shown in FIG. 15 is of particular importance in respect with harmonizing the use characteristics. A design of a racket according to the invention requires a compromise of "optical weight", strength and mass relations and aerodynamic drag coefficients. The term "optical weight" is a volume-related value which should express the fact that even though the racket is voluminous, this does not necessarily mean that the actual weight is great.

Referring now to FIGS. 16*a* to 16*d*, there are shown exemplified variations in the type racket as shown in FIG. 6*a* i.e. a racket with three joints, with particular illustration of different orientations of the axes of rotation 7 and positions of the point of intersection A to show variations by which a player may adjust the racket to his or her individual needs.

Figure 16A:
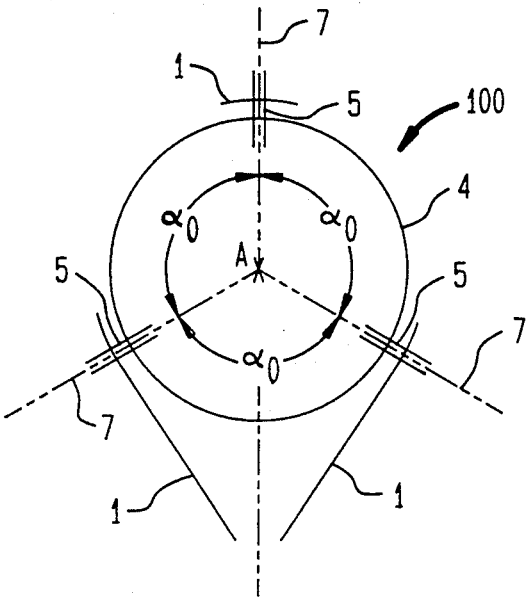
FIGS. 16*a* to 16*d* are schematic illustrations in plan view of a racket of the type shown in FIGS, 1*a* and 1*b*, with three joints and three axes of rotation with varying position of the intersection of the axes of rotation.

In FIG. 16*a*, the joints 5 between the outer frame 1 and the inner frame 4 are spaced about the racket head 100 in such a manner that the axes of rotation 7 are distanced from each other at a same angle $\alpha_o$ of 120° so that the point of intersection A of the axes of rotation 7 coincides with the center of the racket head 100.

Figure 16B:
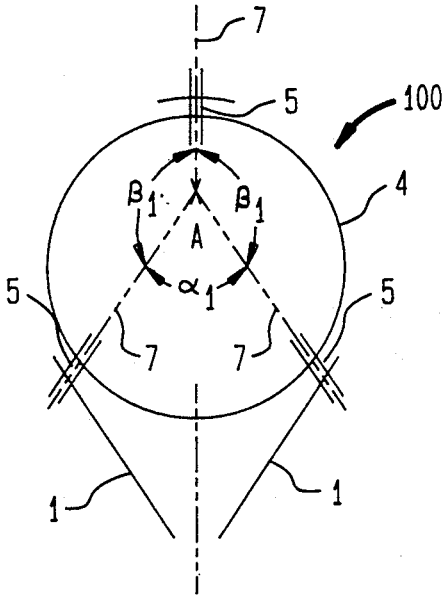

FIG. 16*b* illustrates a similar arrangement as in FIG. 16*a*, with the difference residing in the orientation of the joints 5 and thus of the axes of rotation 7 which are spaced from each other by an angle $\alpha_1$ and two angles $\beta_1$ and intersect in a point of intersection A positioned in the crown-near area of the racket head 100.

Figure 16C:
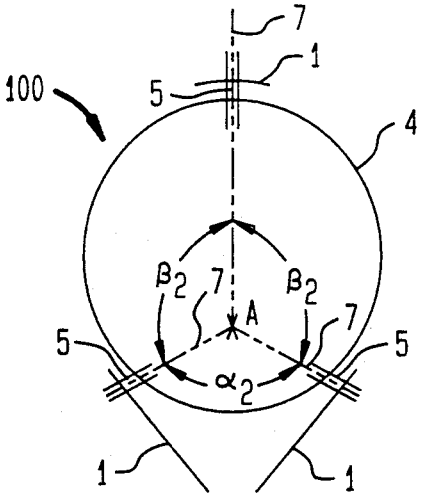

FIG. 16*c* shows a modification of FIG. 16*b* with an arrangement of the joints 5 in which the point of intersection A is shifted to the throat-near area of the racket head 100, with the axes of rotation 7 spaced by an angle $\alpha_2$ and two angles $\beta_2$ (greater than 90°).

Figure 16D:
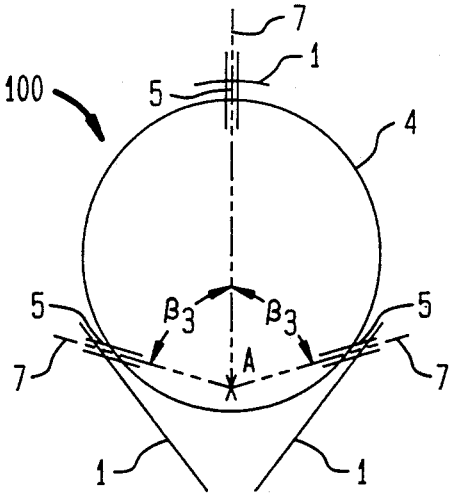

FIG. 16*d* shows a variation of the arrangement of the opposing joints 5, with the axes of rotation 7 as defined by the opposing joints being oriented towards the throat so that the point of intersection A is shifted further to the throat-near area of the racket head 100 and may even be located outside the racket head. Thus, the angles $\beta_3$ between the axes of rotation 7 as defined by the opposing joints 5 in vicinity of the throat and the axis of rotation 7 as defined by the joint 5 in the crown of the racket head 100 are less than 90°.

It will be appreciated by persons skilled in the art that the above examples of morphologically gained rackets is only illustrative and not exhaustive and that other combinations of rackets, especially tennis rackets, with two, three and four joints are possible. By fixing or releasing the axial degree of freedom in the individual joint, an isostatic bearing may be completely or nearly realized.

While the invention has been illustrated and described as embodied in a racket for striking a ball, it is not intended to be limited to the details shown since various modifications and structural changes may be made without departing in any way from the spirit of the present invention.

I claim:

1. A racket for striking a ball; comprising:

a racket head defining a racket plane and including a stringed inner frame and an outer support frame which at least partly encloses said inner frame and is connected to a handle; and joint means for hingedly connecting said inner frame with said outer frame, said joint means defining at least two axes of rotation which are oriented parallel to said racket plane without coinciding with each other, said joint means allowing a local rotation of said inner and outer frames relative to each other at each point of articulation and preventing a relative translational motion of said inner and outer frames perpendicular to said racket plane.

2. A racket as defined in claim 1 wherein said joint means includes at least two joints.

3. A racket as defined in claim 1 wherein said joint means includes at least one joint arranged at a crown area of said racket head and at least one further joint arranged in a handle-near area to midsection of said racket head.

4. A racket as defined in claim 3 wherein said joint means includes up to four joints.

5. A racket as defined in claim 1 wherein said joint means includes at least one pivot joint defining an axis of rotation which is oriented parallel to said racket plane, wherein said pivot joint allows a relative deflection of the outer and inner frames along the axial direction of the pivot joint.

6. A racket as defined in claim 1, and further comprising a resiliently attenuating element acting essentially in axial direction and enclosing said joint means for absorbing movements of said inner and outer frames in axial direction.

7. A racket as defined in claim 1 wherein said joint means includes at least one ball-and-socket joint defining at least one axis of rotation.

8. A racket as defined in claim 7 wherein said ball-and-socket joint defines up to three axes of rotation to allow orthogonal rotational motions relative to each other.

9. A racket as defined in claim 1 wherein said racket head defines a longitudinal axis, said joint means including three joints, each of which defining an axis of rotation, with said three axes of rotation intersecting upon said longitudinal axis.

10. A racket as defined in claim 1 wherein said racket head defines a longitudinal axis, said joint means including at least two joints arranged in such a manner that two axes of rotation are oriented perpendicular to and intersecting each other, with one axis of rotation coinciding with said longitudinal axis.

11. A racket as defined in claim 10 wherein said joint means includes three joints.

12. A racket as defined in claim 1 wherein said joint means includes at least two joints defining two parallel axes of rotation.

13. A racket as defined in claim 12 wherein said joint means includes three joints, with two joints defining a common axis of rotation.

14. A racket as defined in claim 12 wherein said joint means includes four joints, with two paired joints defining a common axis of rotation.

15. A racket as defined in claim 1 wherein said joint means includes four joints defining two axes of rotation intersecting each other and extending perpendicular to each other.

16. A racket as defined in claim 1 wherein said joint means allows an essentially isostatic support of said inner and outer frames.

17. A racket as defined in claim 1 wherein said racket head defines a longitudinal axis, said joint means including joints, each defining an axis of rotation, with said axes of rotation intersecting at a point of intersection which at non-deformed racket lies in said racket plane upon said longitudinal axis, with said common point of intersection extending inside or outside the stringing area of said stringed inner frame.

18. A racket as defined in claim 1 wherein said joint means includes at least one pivot joint defining an axis of rotation which is oriented parallel to said racket plane, wherein said pivot joint prevents a relative deflection of the outer and inner frames along the axial direction of the pivot joint.

19. A racket for striking a ball; comprising:

a racket head defining a longitudinal axis and including a stringed inner frame and an outer support frame which at least partly encloses said inner frame; and joint means for hingedly connecting said inner frame with said outer frame and allowing a rotation of both frames relative to each other at each point of articulation, said joint means including three joints, with one joint defining an axis of rotation coinciding with said longitudinal axis, and with each of said other two joints defining an axis of rotation, with said two axes of rotation of said other two joints intersecting upon said longitudinal axis.

20. A racket for striking a ball; comprising:

a racket head defining a longitudinal axis and including a stringed inner frame and an outer support frame which at least partly encloses said inner frame; and joint means for hingedly connecting said inner frame with said outer frame and allowing a rotation of both frames relative to each other at each point of articulation, said joint means including at least two joints arranged in such a manner that two axes of rotation are oriented perpendicular to and intersecting each other, with one axis of rotation coinciding with said longitudinal axis.

21. A racket for striking a ball; comprising:

a racket head defining a longitudinal axis and including a stringed inner frame and an outer support frame which at least partly encloses said inner frame; and joint means for hingedly connecting said inner frame with said outer frame and allowing a rotation of both frames relative to each other at each point of articulation, said joint means including at least two joints defining two axes of rotation which are oriented parallel at a distance to each other and extend perpendicular to said longitudinal axis.

22. A racket for striking a ball; comprising:

a racket head including a stringed inner frame and an outer support frame which at least partly encloses said inner frame; and joint means for hingedly connecting said inner frame with said outer frame and allowing a rotation of both frames relative to each other at each point of articulation, said joint means including four joints defining two axes of rotation intersecting each other and extending perpendicular to each other.

* * * * *

UNITED STATES PATENT AND TRADEMARK OFFICE

CERTIFICATE OF CORRECTION

PATENT NO. : 5,178,388

DATED : January 12, 1993

INVENTOR(S) : ECKARD SCHLENKER

It is certified that error appears in the above-identified patent and that said Letters Patent is hereby corrected as shown below:

Column 1, line 52, correct "coil springs outside" to -- coil springs - outside --.

Column 2, line 17, after "by" add -- pivots to a bifurcated shaft with handle. The use of spring --.

Column 3, line 18, after "and" add -- stringing frequencies. Position and size of the "sweet spot" --.

Column 8, line 35, before "impact" add -- oscillation amplitudes--.

Column 10, line 58, instead of "to 6d" please read -- 6e --.

In the Drawings:

Top FIG. on page 1 of the formal drawing should be labeled as -- FIG. la--.

Signed and Sealed this

First Day of February, 1994

Bruce Lehman

*Attest:*

BRUCE LEHMAN

*Attesting Officer*

*Commissioner of Patents and Trademarks*